US005980017A

United States Patent [19]

Sato

[11] Patent Number: 5,980,017

[45] **Date of Patent: *Nov. 9, 1999**

[54] PROCESS FOR THE PRODUCTION OF A LIQUID JET RECORDING HEAD

[75] Inventor: Tamaki Sato, Kawasaki, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/783,289

[22] Filed: Jan. 10, 1997

[30] Foreign Application Priority Data

Jan. 12, 1996 [JP] Japan ..... 8-003437

[51] Int. Cl.[6] ..... B41J 2/015; B05D 3/00

[52] U.S. Cl. ..... 347/20; 427/555; 216/27

[58] Field of Search ..... 427/555, 240, 427/386; 216/27, 41, 67; 347/20, 45, 65, 56; 430/286

[56] References Cited

U.S. PATENT DOCUMENTS

| | | | |
|---|---|---|---|
| 4,657,631 | 4/1987 | Noguchi | 156/655 |
| 5,478,606 | 12/1995 | Ohkuma et al. | 427/240 |

FOREIGN PATENT DOCUMENTS

| | | |
|---|---|---|
| 62-234941 | 10/1987 | Japan . |
| 4-10940 | 1/1992 | Japan . |
| 4-10941 | 1/1992 | Japan . |
| 6-286149 | 10/1994 | Japan . |

*Primary Examiner*—Ponnathapura Achutamurthy
*Assistant Examiner*—P. Ponnaluri
*Attorney, Agent, or Firm*—Fitzpatrick, Cella, Harper & Scinto

[57] ABSTRACT

A process for producing a liquid jet recording head, comprising the steps of: providing a substrate for a liquid jet recording head, which is provided with a heat generating resistor; forming a thermoplastic resin layer capable of being solubilized on the substrate; subjecting the thermoplastic resin layer on the substrate to patterning treatment to form an ink pathway pattern in a state that the heat generating resistor is positioned at the bottom of the ink pathway pattern while being covered by the ink pathway pattern; subjecting the ink pathway pattern to heat treatment at a higher temperature than the melting point of the thermoplastic resin layer constituting the ink pathway pattern to round corners of the ink pathway pattern into a rounded ink pathway pattern; forming a resin coat layer on the substrate having the rounded ink pathway pattern thereon; forming an ink discharge outlet at a portion of the resin coat layer which is situated right above the heat generating resistor; and eluting the rounded ink pathway pattern constituted by the thermoplastic resin material layer to form an ink pathway in communication with the ink discharge outlet.

4 Claims, 4 Drawing Sheets

PROCESS FOR THE PRODUCTION OF A LIQUID JET RECORDING HEAD

BACKGROUND OF THE INVENTION

1. Field of the Invention

The present invention relates to a process for producing a liquid jet recording head which is used in a liquid jet recording system by depositing printing liquid droplets on a printing medium. More particularly, the present invention relates to a process for producing a so-called side-shooter type liquid jet recording head which discharges printing liquid droplets (or ink droplets) in a direction perpendicular to its substrate containing a liquid discharge pressure generating element installed therein. The present invention includes a side-shooter type liquid jet recording head produced by said process.

2. Related Background Art

Japanese Unexamined Patent Publication No. 234941/1987 discloses a typical process of producing a side-shooter type liquid jet recording head by joining an orifice plate produced by way of electroforming to a substrate having an ink discharge pressure generating element formed therein through a patterned dry film. FIG. 3(*a*) is a schematic cross-sectional view illustrating an example of a side-shooter type liquid jet recording head produced by said process. Particularly, the liquid jet recording head shown in FIG. 3(*a*) comprises a substrate 11 having an ink discharge pressure generating element 12 therein which is joined to an orifice plate 15 through a dry film 18 to form a liquid pathway. Reference numeral 16 indicates an ink discharge outlet provided above the ink discharge pressure generating element 12. Reference numeral 17 indicates a bubbling chamber provided at a portion where the liquid pathway is communicated with the ink discharge outlet 16. The substrate 11 including the ink discharge pressure generating element 12 constitutes a bottom wall of the bubbling chamber 17. The bubbling chamber 17 retains ink therein. When the ink discharge pressure generating element 12 comprises an electrothermal converting element (or a heat generating resistor), a thermal energy is applied to the ink in the bubbling chamber 17 by the electrothermal converting body to cause a state change in the ink, where a bubble is generated in the ink and the pressure which occurs upon the generation of the bubble makes the ink in the bubbling chamber 17 discharge through the discharge outlet 16.

Now, in this liquid jet recording head, there is an occasion where an undesired air bubble is contaminated into the liquid pathway. This occurs mainly because when the temperature of the ink is changed, air dissolved in the ink is vaporized to form such air bubble in the ink or because external air is contaminated into the liquid pathway during the supply of the ink to form such air bubble in the liquid pathway. In the case where the amount of the air bubble is slight, it is emitted outside the head together with the ink discharged. However, in the case where the air bubble remains while being adhered on the circumferential wall or the like of the liquid pathway, the air bubble is liable to grow, resulting in imparting a negative influence to the ink discharging performance. Particularly, when the air bubble is grown and contaminated into the bubbling chamber, the grown air bubble present in the bubbling chamber is liable to entail a problem in that it absorbs the pressure used for discharging ink from the discharge outlet, so the ink is discharged from the discharge outlet in a defective state.

More particularly, the bubbling chamber 17 of the liquid jet recording head has corner portions (20) on the discharge outlet side, where the flow of ink is likely to stagnate at the corner portions. When the foregoing contaminating air bubble should enter into the corner portions 20 as shown in FIG. 3(*a*), the contaminating air bubble stays therein to grow, whereby entailing problems such that the frequency of ink to be refilled is decreased and the direction for an ink droplet to be flying is deviated, resulting in causing dislocation for the ink droplet deposited on a recording medium and making the ink discharging performance unstable. Further, when the contaminating air bubble staying in the corner portions should be greatly grown, the ink discharging performance is sometimes disabled.

Japanese Unexamined Patent Publications Nos. 10940/1992 and 10941/1992 disclose a side-shooter type liquid jet recording head having the configuration as shown in FIG. 3(*b*) in which no dry film is used, which comprises a substrate 11 having a heat generating resistor 12 (or a ink discharge pressure generating element) and an orifice plate 15 joined to said substrate to form a liquid pathway. The liquid jet recording head shown in FIG. 3(*b*) is provided with an ink discharge outlet 16 situated above the heat generating resistor 12 and a bubbling chamber 17 in communication with the discharge outlet 16. The substrate 11 including the ink heat generating resistor 12 constitutes a bottom wall of the bubbling chamber 17. The bubbling chamber 17 retains ink therein. In the liquid jet recording head shown in FIG. 3(*b*), thermal energy is applied to the ink in the bubbling chamber 17 by the heat generating resistor 12 to cause a state change in the ink whereby generating a bubble in the ink, where the bubble generated is communicated with outside air to make the ink in the bubbling chamber 17 discharge through the discharge outlet 16.

In the liquid jet recording head shown in FIG. 3(*b*), outside air eventually enters into the bubbling chamber 17 and because of this, an air bubble often remains in the bubbling chamber 17 without being emitted to the outside. When said air bubble is adhered at corner portions 20 of the bubbling chamber 17, a discharged volume itself is varied to make the resulting print to be accompanied by unevenness or stripes. When the air bubble stays in the corner portions 20, as well as in the case shown in FIG. 3(*a*), there are problems in that the frequency of ink to be refilled is decreased and the direction for an ink droplet to be flying is deviated, resulting in causing dislocation for the ink droplet deposited on a recording medium and making the ink discharging performance unstable. Further, when the ink in the corner portions 20 does not flow, residual ink causes problem of making the ink discharging performance unstable.

The above-described problems will become significant as the size of an ink droplet to be discharged is diminished so as to comply with the conditions for obtaining a highly precise fine image.

Hence, any of the conventional side-shooter type liquid jet recording heads is problematic in that the corner portions present at the upper position of the bubbling chamber entail such negative influences as above described to the ink discharging performance. In the prior art, there cannot be found an adequate manner for effectively producing a desirable side-shooter type liquid jet recording head with no corner portion in the bubbling chamber.

SUMMARY OF THE INVENTION

The present invention is aimed at eliminating the foregoing problems found in the prior art and providing a desirable side-shooter type liquid jet recording head which ensures stable ink discharging even in the case of conducting recording by way of discharging fine ink droplets.

Another object of the present invention is to provide a process which enables efficient production of said side-shooter type liquid jet recording head.

A typical embodiment of the process for producing a side-shooter type liquid jet recording head (hereinafter referred to as liquid jet recording head) comprises the steps of: (a) providing a substrate for a liquid jet recording head, which is provided with a heat generating resistor, (b) forming a thermoplastic resin layer capable of being solubilized on said substrate, (c) subjecting the thermoplastic resin layer on the substrate to patterning treatment to form an ink pathway pattern in a state that the heat generating resistor is positioned at the bottom of the ink pathway pattern while being covered by the ink pathway pattern, (d) subjecting the ink pathway pattern to heat treatment at a higher temperature than the melting point of the thermoplastic resin layer constituting the ink pathway pattern to round corners of the ink pathway pattern into a rounded ink pathway pattern, (e) forming a resin coat layer on the substrate having the rounded ink pathway pattern thereon, (f) forming an ink discharge outlet at a portion of the resin coat layer which is situated right above the heat generating resistor, and (g) eluting the rounded ink pathway pattern constituted by the thermoplastic resin layer to form an ink pathway in communication with the ink discharge outlet.

This process enables efficient production or a desirable liquid jet recording head having a bubbling chamber free of such corners as found in the conventional liquid jet recording head and in which the deleterious effects on the ink discharging performance due to the contaminating air bubble which are found in the conventional liquid jet recording head are markedly diminished. In addition, the orifice plate in the vicinity of the discharge outlet is relatively thin but it is gradually thickened as it becomes remote from the discharge outlet and because of this, the strength of the orifice plate in the vicinity of the discharge outlet is markedly improved.

Now, the term discharge outlet in the present invention means an opening situated at the outermost surface through which ink is discharged. The term liquid pathway (or ink pathway) means a passage extending from the ink supply port through the discharge outlet. The bubbling chamber corresponds to a part of the liquid pathway (or the ink pathway) and it means a small chamber having the heat generating resistor at the bottom portion thereof and an opening communicating with the discharge outlet at the ceiling portion thereof and which is circumscribed by the wall constituting the liquid pathway (or the ink pathway).

A further object of the present invention is to provide a highly reliable liquid jet recording head produced by the above-described process, which always ensures stable ink discharging even in the case of conducting recording by way of discharging fine ink droplets.

BRIEF DESCRIPTION OF THE DRAWINGS

FIG. 3(*b*) is a schematic cross-sectional view illustrating another example of a conventional liquid jet recording head.

DESCRIPTION OF THE INVENTION AND PREFERRED EMBODIMENTS

Figure 1:
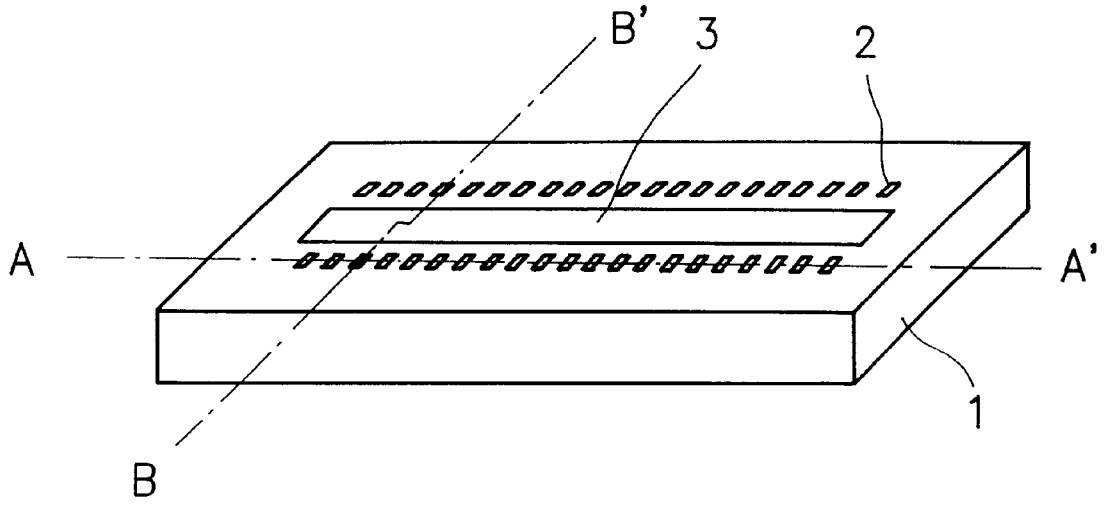
FIG. 1 is a schematic slant view illustrating an example of a substrate for a liquid jet recording head, which is used in the present invention.

The present invention attains the above objects. Particularly, the present invention provides a highly reliable liquid jet recording head which is free of the foregoing problems found in the prior art and a process which enables efficient production of said liquid jet recording head.

The present invention principally lies in a process for producing a liquid jet recording head including an ink pathway including a bubbling chamber which is communicated with a discharging outlet and a heat generating resistor for generating energy utilized for discharging ink from said discharging outlet, said process comprising the steps of: (a) providing a substrate for a liquid jet recording head, which is provided with a heat generating resistor, (b) forming a thermoplastic resin layer capable of being solubilized on said substrate, (c) subjecting the thermoplastic resin layer on the substrate to patterning treatment to form an ink pathway pattern in a state that the heat generating resistor is positioned at the bottom of the ink pathway pattern while being covered by the ink pathway pattern, (d) subjecting the ink pathway pattern to heat treatment at a higher temperature than the melting point of the thermoplastic resin layer constituting the ink pathway pattern to round corners of the ink pathway pattern into a rounded ink pathway pattern, (e) forming a resin coat layer on the substrate having the rounded ink pathway pattern thereon, (f) forming an ink discharge outlet at a portion of the resin coat layer which is situated right above the heat generating resistor, and (g) eluting the rounded ink pathway pattern constituted by the thermoplastic resin material layer to form an ink pathway in communication with the ink discharge outlet.

In the following, the present invention will be described while referring to the drawings.

FIG. 1 is a schematic slant view illustrating an example of a substrate for a liquid jet recording head, which is used for the production of a liquid jet recording head in the present invention.

In FIG. 1, reference numeral 1 indicates a substrate for a liquid jet recording head, reference numeral 2 a heat generating resistor capable of generating energy utilized for discharging ink, and reference numeral 3 an ink supply port comprising a throughhole shaped in the form of a long groove.

In the substrate 1 shown in FIG. 1, the ink supply port 3 is positioned in a central area of a surface of the substrate and a plurality of heat generating resistors 2 are spacedly arranged on each of the opposite sides of the ink supply port 3.

A typical embodiment of a liquid jet recording head according to the present invention comprises the substrate shown in FIG. 1 and an orifice plate (not shown) having a pathway wall as an isolation wall for forming a bubbling chamber for each heat generating resistor on the substrate and a plurality of ink discharge outlets. This liquid jet recording head has the configuration shown in FIG. 4.

Figure 4:
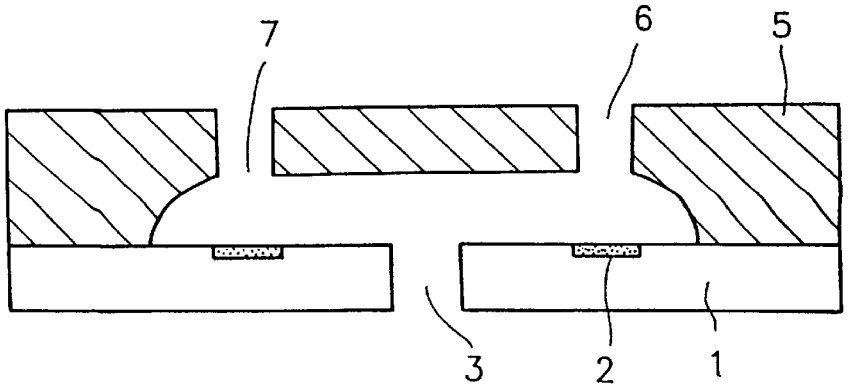
FIG. 4 is a schematic cross-sectional view illustrating an example of a liquid jet recording head according to the present invention.

FIG. 4 is a schematic cross-sectional view taken along the line B–B' in FIG. 1 with respect to the substrate.

In FIG. 4, reference numeral 1 indicates a substrate for a liquid jet recording head, reference numeral 2 a heat generating resistor, reference numeral 3 an ink supply port, reference numeral 5 an orifice plate, reference numeral 6 an ink discharge outlet, and reference numeral 7 a bubbling chamber.

In FIG. 4, the liquid pathway wall is integrally constituted with the orifice plate. But these may be separately constituted.

Herein, description will be made of the shape of the bubbling chamber which is a principal feature of the present invention.

In the liquid jet recording head shown in FIG. 4, the liquid pathway wall of the bubbling chamber 7 has a rounded shape with no corner and which is extending from an end portion of the ink discharge outlet 6 on the liquid pathway side to the substrate 1. By making the liquid pathway wall of the bubbling chamber 7 into such a rounded shape with no corner, the bubbling chamber becomes such that it is substantially free of a portion where the flow of ink stagnates and because of this, when an air bubble should be externally contaminated into the bubbling chamber, the contaminating air bubble is hardly grown in the bubbling chamber. By this, the foregoing problems found in the prior art are effectively prevented from occurring.

In the following, description will be made of the process according to the present invention which enable to the production of a liquid jet recording head having such configuration as above described.

As previously described, the process according to the present invention is that in the production of a liquid jet recording head by forming a patterned resin layer having corners and capable of being eluted in the form of an ink pathway forming pattern on a substrate for a liquid jet recording head, forming a resin coat layer capable of serving as an ink pathway constituent on the substrate such that it covers the patterned resin layer and eluting the patterned resin layer, the corners-bearing patterned resin layer is converted into a rounded, patterned resin layer with no corner, whereby a corner-free bubbling chamber is formed. The formation of said corner-free rounded, patterned resin layer may be conducted, for example, by a manner wherein the starting resin layer for forming the patterned resin later capable of being eluted is formed of a thermoplastic resin, the thermoplastic resin layer is patterned into a ink pathway forming pattern having corners, and the patterned thermoplastic resin layer is subjected to heat treatment at a higher temperature than the melting point of the thermoplastic resin constituting the patterned thermoplastic resin layer.

For the heat treatment temperature in this case, it is important for it to be controlled so that the corners of the patterned thermoplastic resin layer can be rounded without forming a projected region at the patterned thermoplastic resin layer. For this purpose, the heat treatment for the patterned thermoplastic resin layer is desired to be conducted at a temperature of +10° C. to +40° C. higher than the melting point of the thermoplastic resin constituting the patterned thermoplastic resin layer.

In the present invention, the thermoplastic resin material layer is formed of a thermoplastic resin capable of being eluted selected from the group consisting of polymethylisopropenylketone and novolak series positive type resists.

Figure 2:
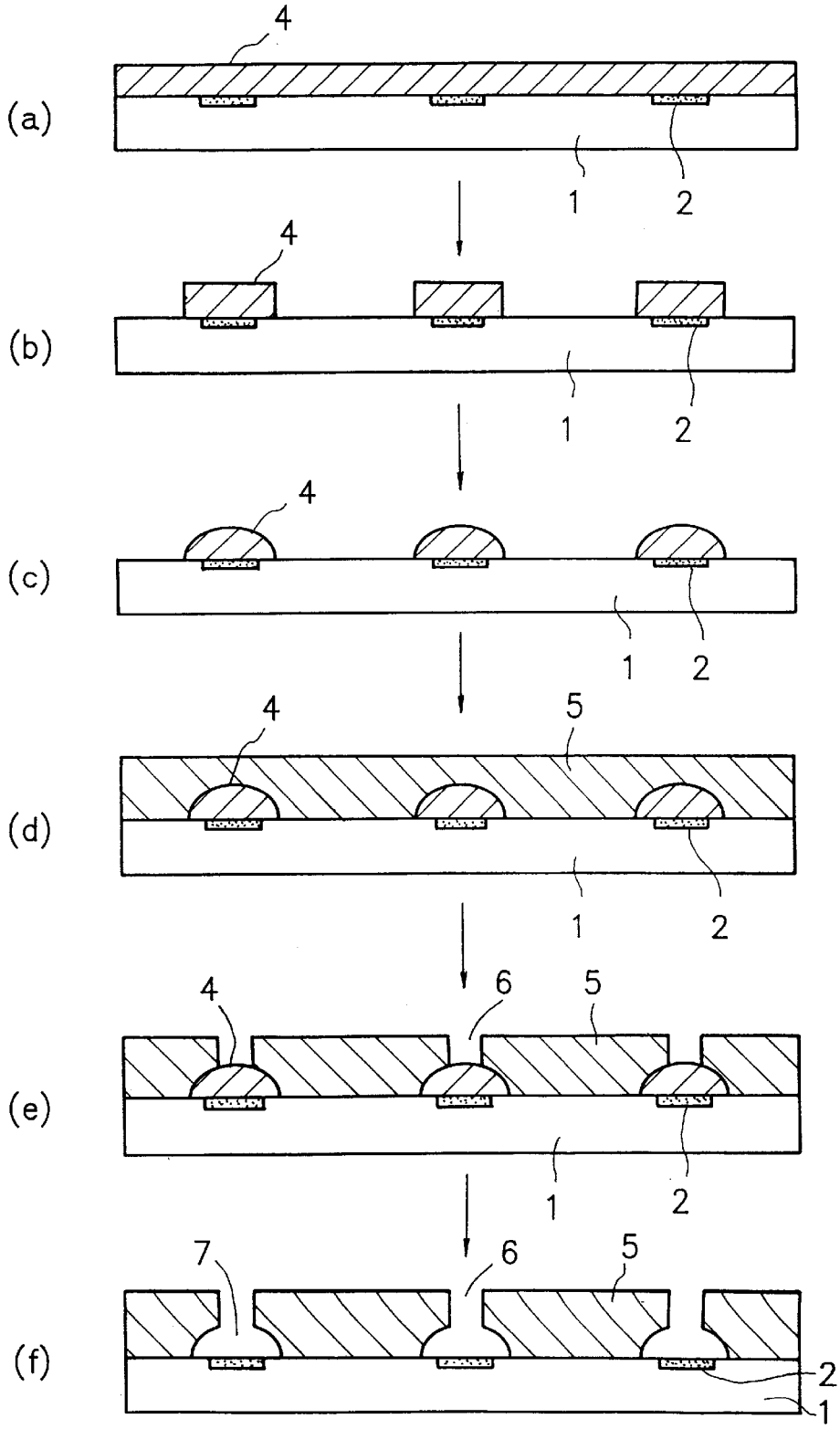
FIGS. 2(*a*) through 2(*f*) are schematic views for explaining production steps of an embodiment of a process for the production of a liquid jet recording head according to the present invention.
Figure 3A:
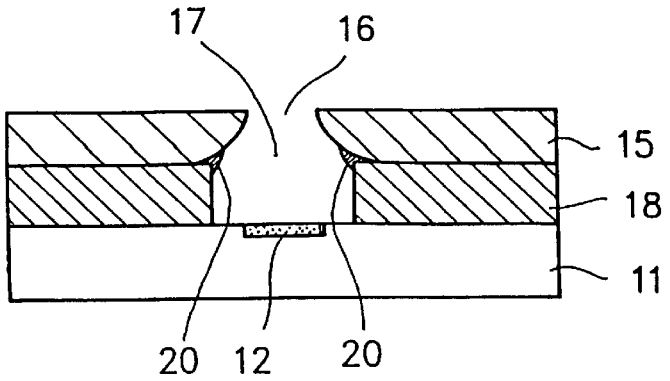
FIG. 3(*a*) is a schematic cross-sectional view illustrating an example of a conventional liquid jet recording head.
Figure 3B:
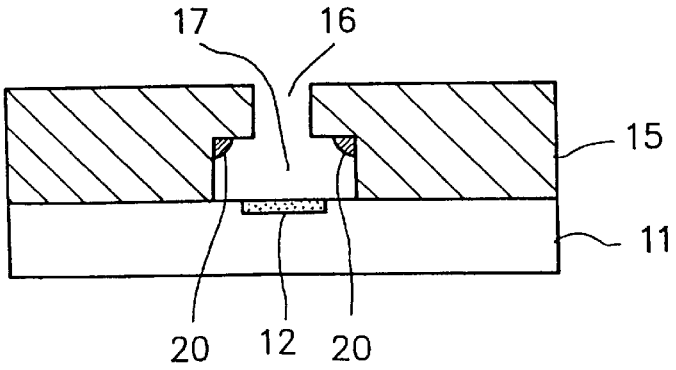

The process according to the present invention for producing a liquid jet recording head may be practiced, for instance, in accordance with the procedures shown in FIGS. 2(*a*) through 2(*f*).

In FIGS. 2(*a*) through 2(*f*), reference numeral 1 indicates a substrate provided with a plurality of heat generating resistors 2 for a liquid jet recording head. This substrate is the same as that shown in FIG. 1. Particularly, the cross-sectional view of the substrate 1 shown in FIGS. 2(*a*) through 2(*f*) corresponds to a cross-sectional view taken along the line A–A' in FIG. 1.

Reference numeral 4 indicates a thermoplastic resin material layer, reference numeral 5 a resin coat layer, reference numeral 6 a ink discharge outlet, and reference numeral 7 a bubbling chamber.

In the process according to the present invention, the following steps are conducted.

In a first step, as shown in FIG. 2(*a*), on a substrate 1 provided with a plurality of heat generating resistors 2, there is formed a thermoplastic resin layer 4 capable of being dissolved in a solvent such as a strong alkali solution or an organic solvent. Then, as shown in FIG. 2(*b*), the thermoplastic resin layer 4 formed on the substrate 1 is subjected to patterning treatment by a conventional manner to form an ink pathway pattern having a rectangular cross section with corners for each heat generating resistor 2 in a state that the heat generating resistor is positioned at the bottom of the ink pathway pattern while being entirely covered by the ink pathway pattern.

In a second step, the ink pathway patterns each constituted by the thermoplastic resin layer 4 are subjected to heat treatment at a higher temperature than the melting point of the thermoplastic resin layer. Particularly, for instance, in the case where the thermoplastic resin layer as the ink pathway pattern is composed of polymethylisopropenylketone, the heat treatment is conducted at a higher temperature (for example, 120° C.) than the heat deformation temperature (100° C.) of the polymethylisopropylketone. By this, each rectangular-shaped ink pathway pattern is converted into a rounded ink pathway pattern with no corner as shown in FIG. 2(*c*).

In a third step, as shown in FIG. 2(*d*), a resin coat layer 5 is formed on the substrate 1 so as to entirely cover the rounded ink pathway patterns situated on the substrate. In this case, the resin coat layer 5 is formed of a resin incapable of being dissolved in the foregoing solvent for eluting the thermoplastic resin layer 4.

In a fourth step, as shown in FIG. 2(*e*), an ink discharge outlet 6 is formed right above each heat generating resistor 2 such that it passes through the resin coat layer 5 to reach the rounded ink pathway pattern 4 under which the heat generating resistor 2 is situated.

The formation of the ink discharge outlet 6 may be conducted by a conventional perforation manner by way of etching with $O_2$ plasma or excimer laser or by conventional photolithography using ultraviolet (UV) rays or deep-UV rays. In the case where the formation of the ink discharge outlet is conducted by photolithography, it is desired for the resin coat layer to be constituted by a negative type photosensitive resin incapable of being dissolved in the foregoing solvent for eluting the thermoplastic resin layer 4.

In a fifth step, as shown in FIG. 2(*f*), each of the rounded ink pathway patterns constituted by the thermoplastic resin layer 4 is eluted using the foregoing solvent (a strong alkali solution or an organic solvent) to form an ink pathway and a bubbling chamber 7 with respect to each heat generating resistor 2. The bubbling chamber 7 herein means a small chamber having the heat generating resistor at the bottom portion thereof and an opening communicated with the ink discharge outlet 6 at the ceiling portion thereof.

In this small chamber as the bubbling chamber 7, ink introduced therein is heated by the heat generating resistor 2 to produce a bubble and ink is discharged through the ink discharge outlet 6 in the form of an ink droplet, where the ink droplet is ejected onto a recording medium which is positioned outside the liquid jet recording head so as to correspond to the ink discharge outlet, whereby an image is formed on the recording medium.

After the completion of the fifth step, a wiring board (not shown) for driving the heat generating resistors 2 is electrically connected to the resultant obtained in the fifth step. By this, there is obtained a liquid jet recording head.

Now, the formation of the ink supply port 3 shown in FIG. 1, which serves also as an opening through which ink is introduced into the liquid jet recording head, may be conducted by an appropriate hole-making means as long as a grooved hole capable of serving as the ink supply port 3 can be formed at the substrate 1. As such hole-making means, there can be mentioned, for example, mechanical hole-making means such as drilling, hole-making means using light energy such as a laser, and hole-making means by way of chemical etching. It is possible for the ink supply port to be formed at the substrate in advance. Alternatively, the formation of the ink supply port may be conducted after the nozzle portions such as the ink pathway, ink discharge outlets and the like have been formed.

For the liquid jet recording head thus prepared, the ink pathways and bubbling chambers 7 are substantially free of a portion where the flow of ink stagnates. Therefore, upon operating the liquid jet recording head to discharge ink droplets whereby conducting recording an image on a recording medium, even if an undesired air bubble should be contaminated into the ink pathways and/or bubbling chambers, there is no occasion for the air bubble to stay therein. And upon discharging ink through the ink discharge outlets, the ink in the ink pathways and bubbling chamber is forced to smoothly move toward the ink discharge outlets by virtue of a pressure generated upon the production of the bubble and it is efficiently discharged through the ink discharge outlets as desired without causing a waste ink residue.

The present invention is the most advantageous particularly when it is employed in a recording head in which a liquid jet system is used which is described in Japanese Unexamined Patent Publications Nos. 10940/1992 and 10941/1992. These documents describe an ink discharging manner wherein a driving signal corresponding to a recording information is supplied to an electrothermal converting body (a heat generating resistor) to make the electrothermal converting body generate thermal energy, thus causing a sudden temperature rise beyond the nuclear boiling of ink thereby producing a bubble in the ink, followed by connecting the bubble with outside air, thereby discharging an ink droplet. When the present invention is employed in this case, the volume and speed of the ink droplet discharged can be desirably stabilized and there can be attained a high quality recorded image.

Further, when the present invention is adopted in the case of forming a ink pathway wall and an orifice plate at the same time by way of forming, on a resin layer capable of being eluted, a resin coat layer by a solvent-coating process as described in Japanese Unexamined Patent Publication No. 286149/1994, there is provided a pronounced advantage in that the resin coat layer formed does not follow the uneven surface caused due to the resin layer and substrate and because of this, there can be attained the formation of a desirable discharge outlet surface having an improved flatness at the surface of the resin coat layer.

Further in addition, when the present invention is adopted in a side-shooter type liquid jet recording head in which ink is discharged in an upward direction above the electrothermal converting body, there is provided an pronounced advantage in that the orifice plate is relatively thin in the vicinity of the discharge outlet but it is gradually thickened as it becomes remote from the discharge outlet and because of this, the strength of the orifice plate in the vicinity of the discharge outlet is markedly improved.

Separately, the present invention is effective in the production of a highly reliable full-line type liquid jet recording head which can perform recording for the entire width of a recording medium at the same time.

Further, the liquid jet recording heads produced according to the present invention are not varied in terms of their ink discharging performance. Therefore, the present invention is effective in the production of a color type liquid jet recording head. The color type liquid jet recording head may be of a configuration in that a plurality of colors are integrated or a configuration comprising a plurality of liquid jet recording heads.

In the following, the present invention will be described in more detail with reference to examples. It should be understood that these examples are only for illustrative purposes and not intended to restrict the scope of the present invention.

EXAMPLE 1

Figure 5:
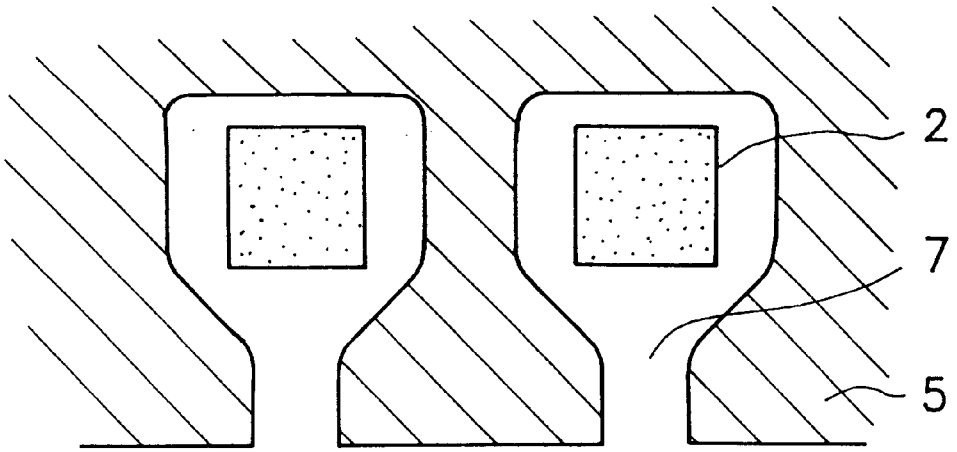
FIG. 5 is a schematic view illustrating an example of the shape of a bubbling chamber of an liquid jet recording head according to the present invention.

In this example, in accordance with the production procedures shown in FIGS. 2(*a*) through 2(*f*), there was prepared a liquid jet recording head having the configuration shown in FIG. 4 and FIG. 2(*f*) and having a plurality of bubbling chambers shaped as shown in FIG. 5. FIG. 5 is a schematic cross-sectional view illustrating a plane containing ink pathways including bubbling chambers which is horizontal to the substrate.

The liquid jet recording head was prepared as will be described below.

(1). There was provided a substrate 1 made of silicon having a long groove-like shaped throughhole as an ink supply port 3 formed at a central area of the surface thereof and having a plurality of heat generating resistors 2 made of tantalum nitride spacedly arranged at an equal interval on each of the opposite sides of the ink supply port 3.

(2). On the surface of the substrate 1, a coating liquid comprised of polymethylisopropenylketone was applied in an amount to provide a thickness of 30 $\mu$m by means of a conventional dip coating process, followed by drying. By this, there was formed a 30 $\mu$m thick resin layer 4 capable of being eluted on the substrate 1 as shown in FIG. 2(*a*).

(3). The resin layer 4 formed on the substrate 1 was subjected to patterning treatment by a conventional photolithography using a patterning mask to form a plurality of ink pathway patterns such that one of the heat generating resistors 2 is positioned at the bottom of one of the ink pathway patterns while being entirely covered by the ink pathway pattern.

(4). Each of the ink pathway patterns thus formed was subjected to heat treatment at about 120° C. for 20 minutes to convert it into a rounded ink pathway pattern.

Thereafter, on the surface of the substrate 1 having the rounded ink pathway patterns thereon, a coating liquid comprised of a bisphenol A epoxy resin added with a photo curing catalyst SP-170 (produced by ADEKA Kabushiki Kaisha) was applied by a conventional spin coating process, followed by drying. By this, there was formed a resin coat layer 5 so as to entirely cover the rounded ink pathway patterns situated on the substrate.

(5). A number of openings of 20 $\mu$m in diameter serving as ink discharge outlets 6 were formed at respective portions of the resin coat layer 5 each situated right above one of the heat generating resistors 2 at an arrangement density of 600 d.p.i. such that each opening passed through the resin coat layer to reach one of the rounded ink pathway patterns, by a conventional photolithography using UV rays. In this case, the resin coat layer 5 could be adequately cured with the irradiation of the UV rays. In order to sufficiently cure the resin coat layer 5, the resin coat layer at which the openings were formed was subjected to heat treatment at 60° C. for 30 minutes.

(6). The resultant obtained in the above step (5) was immersed in methyl lactate to elute the rounded ink pathway patterns, followed by washing with pure water for about 10 minutes and drying.

By this, there was obtained a liquid jet recording head.

Evaluation

Using the resultant liquid jet recording head, recording was conducted on a plurality of A4 sized papers using an ink composed of 79.4 parts by weight of pure water, 15 parts by weight of diethylene glycol, 3 parts by weight of isopropyl alcohol, 0.1 part by weight of lithium acetate and 2.5 parts by weight of a black dye Food Black 2 and a test pattern having solid four corners and a solid black central area for the measurement of optical density.

As a result, even when the ink discharging frequency (f) was raised up to 10 kHz, there was obtained a high quality print product with neither stripe nor unevenness.

For each of the resultant print products, its optical density (O.D.) was measured by means of a Macbeth reflection densitometer RD-918 (produced by Macbeth Company). The measured results revealed a mean optical density of 1.40.

Comparative Example

The procedures of Example 1 were repeated, except that the heat treatment in step (4) was not conducted, to thereby obtain a liquid jet recording head.

Using the resultant liquid jet recording head, recording was conducted on a plurality of A4 sized papers in the same manner as in Example 1. As a result, there was obtained a print product accompanied by apparent stripes and unevenness when recording was conducted at an ink discharging frequency of 10 kHz.

For each of the resultant print products, its optical density (O.D.) was measured in the same manner as in Example 1. The measured results revealed a inferior mean optical density of 1.20.

EXAMPLE 2

Figure 6:
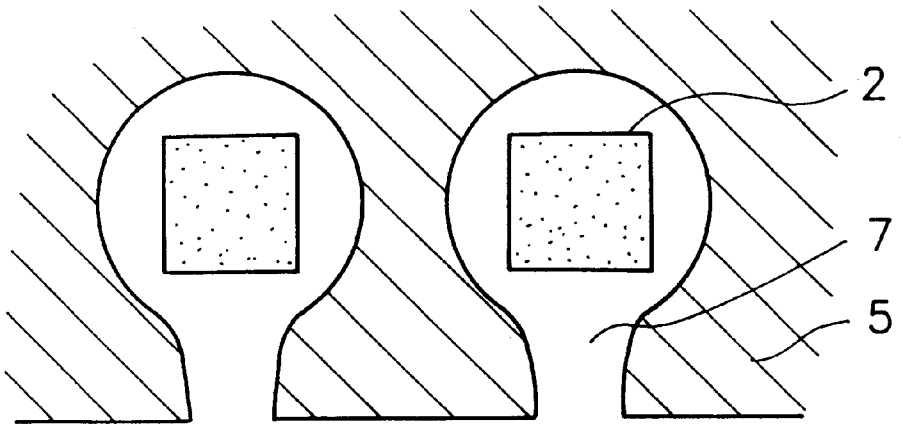
FIG. 6 is a schematic view illustrating another example of the shape of a bubbling chamber of an liquid jet recording head according to the present invention.

In accordance with the procedures of Example 1, there was prepared a liquid jet recording head having the configuration shown in FIG. 4 and FIG. 2(*f*) and having a plurality of bubbling chambers shaped as shown in FIG. 6. FIG. 6 is a schematic cross-sectional view illustrating a plane containing ink pathways including bubbling chambers which is horizontal to the substrate.

Using the resultant liquid jet recording head, recording was conducted on a plurality of A4 sized papers in the same manner as in Example 1.

As a result, even when the ink discharging frequency (f) was raised up to 10 kHz, there was obtained a high quality print product with neither stripes nor unevenness.

For each of the resultant print products, its optical density (O.D.) was measured in the same manner as in Example 1. The measured results revealed a mean optical density of 1.45 which is higher than that in Example 1.

The reason for this is considered to be that since the ink pathways and bubbling chambers are shaped as shown in FIG. 6, a contaminating air bubble is less likely to remain therein and no ink residue occurs at the time of ink discharging.

As is apparent from the above description, according to the present invention, there are provided such pronounced advantages as will be described below.

For a liquid jet recording head produced according to the present invention, even in the case where an air bubble should be contaminated in the ink pathways including the bubbling chambers upon discharging ink, the contaminating air bubble neither remains nor grows therein. Therefore, the liquid jet recording head exhibits a stable ink discharging performance without deviating the flying direction of an ink droplet discharged even in the case where it is operated at a very high ink discharging frequency, where a high quality print product is always obtained. And when the liquid jet recording head is maintained without being used over a long period of time and during which, if an air bubble should contaminate the ink pathways including the bubbling chambers, the contaminating air bubble can be readily and surely removed by recovery treatment or the like, where a high quality print product is ensured to be continuously obtained.

The present invention enables the efficient production of a highly reliable liquid jet recording head of a system in which a bubble produced in ink by virtue of thermal energy generated by the heat generating resistor is connected with outside air to discharge ink. Particularly, in the liquid jet recording head, the entire volume of a ink in the bubbling chamber is discharged in the form of a desirable ink droplet with a stable volume for the ink droplet discharged and at a stable discharging speed without causing a residual ink and without deviating the flying direction of the ink droplet discharged, where a high quality print product can be continuously obtained.

What is claimed is:

1. A process for producing a liquid jet recording head comprising an ink pathway, which comprises a bubbling chamber, said ink pathway communicating with a discharging outlet, and a heat generating resistor for generating energy for discharging ink from said discharging outlet, said process comprising the steps of:

(a) providing a substrate for a liquid jet recording head, said substrate comprising a heat generating resistor;

(b) forming a thermoplastic resin layer on said substrate;

(c) subjecting the thermoplastic resin layer on the substrate to a patterning treatment to form an ink pathway pattern so that the ink pathway pattern is positioned on top of the heat generating resistor;

(d) subjecting the ink pathway pattern to heat treatment at a higher temperature than the melting point of the thermoplastic resin layer to obtain a rounded ink pathway pattern;

(e) forming a resin coat layer on the substrate having the rounded ink pathway pattern thereon;

(f) forming an ink discharge outlet at a portion of the resin coat layer which is situated right above the heat generating resistor; and (g) eluting the rounded ink pathway pattern constituted by the thermoplastic resin material layer to form an ink pathway in communication with the ink discharge outlet.

2. The process according to claim 1, wherein the thermoplastic resin layer is formed of a thermoplastic resin selected from the group consisting of polymethylisopropenylketone and novolak series positive type resists.

3. A liquid jet recording head produced in accordance with the process of claim 1 or 2.

4. A liquid jet recording head according to claim 3 in which a bubble produced by virtue of a thermal energy generated by the heat generating resistor is connected with outside air upon discharging ink.

* * * * *

UNITED STATES PATENT AND TRADEMARK OFFICE

CERTIFICATE OF CORRECTION

PATENT NO. : 5,980,017

DATED : November 9, 1999

INVENTOR(S) : TAMAKI SATO

It is certified that error appears in the above-identified patent and that said Letters Patent is hereby corrected as shown below:

COLUMN 2:

Line 5, "whereby" should read --thereby--.
Line 29, "whereby" should read --, thereby--.

COLUMN 3:

Line 28, "or" should read --of--.

COLUMN 4:

Line 7, "an" should read --a--.

COLUMN 5:

Line 32, "enable to" should read --enables--.

COLUMN 7:

Line 35, "whereby" should read --, thereby--.

UNITED STATES PATENT AND TRADEMARK OFFICE

CERTIFICATE OF CORRECTION

PATENT NO. : 5,980,017

DATED : November 9, 1999

INVENTOR(S) : TAMAKI SATO

It is certified that error appears in the above-identified patent and that said Letters Patent is hereby corrected as shown below:

COLUMN 8:

Line 10, "an" should read --a--.

COLUMN 10:

Line 43, "a" should be deleted.

Signed and Sealed this

Twenty-eighth Day of November, 2000

*Attest:*

Q. TODD DICKINSON

*Attesting Officer*

*Director of Patents and Trademarks*